US005177975A

United States Patent [19]

Mertens

[11] Patent Number: 5,177,975

[45] Date of Patent: Jan. 12, 1993

[54] APPARATUS FOR PREPARATION OF PROCESS WATER FOR PRESSES

[75] Inventor: Heinz-Josef Mertens, Hamm, Fed. Rep. of Germany

[73] Assignee: technotrans gmbh, Sassenberg, Fed. Rep. of Germany

[21] Appl. No.: 725,649

[22] Filed: Jul. 3, 1991

[30] Foreign Application Priority Data

Jul. 4, 1990 [DE] Fed. Rep. of Germany ... 9010152[U]
Feb. 19, 1991 [DE] Fed. Rep. of Germany ... 9101888[U]

[51] Int. Cl.[5] ..... B41F 7/24; B05C 11/10; F25D 11/00

[52] U.S. Cl. ..... 62/64; 100/92; 101/487; 62/455

[58] Field of Search ..... 62/440, 455, 62, 64, 62/91, 259.2, 341, DIG. 10; 100/92; 101/487; 237/311, 2 B

[56] References Cited

U.S. PATENT DOCUMENTS

| | | | |
|---|---|---|---|
| 3,156,102 | 11/1964 | Costantini et al. | 62/237 |
| 4,037,650 | 7/1977 | Randall | 237/2 B |
| 4,359,085 | 11/1982 | Mueller | 165/47 |
| 4,457,140 | 7/1984 | Rastelli | 62/261 |

FOREIGN PATENT DOCUMENTS

| | | |
|---|---|---|
| 0020169A1 | 12/1980 | European Pat. Off. . |
| 708807 | 7/1941 | Fed. Rep. of Germany . |
| 1953590B2 | 6/1971 | Fed. Rep. of Germany . |
| 62-64549 | 3/1987 | Japan . |

OTHER PUBLICATIONS

DE-Prospekt: Heidelberg Speedmaster; 1977.
DE-Prospekt der Fa. Etscheid, Betriebsanleitung, Kühlwasser-Ruüch-Kühler, Type IK-H, 11, S.2,3.
DE-Bediernerhandbuch: Farbwerktemperierung TeHe 03, ab Serien-Nr. 2600, Nr. 04/11-07/1186, S.1.

*Primary Examiner*—Albert J. Makay
*Assistant Examiner*—William C. Doerrler
*Attorney, Agent, or Firm*—Griffin, Butler, Whisenhunt & Kurtossy

[57] ABSTRACT

Apparatus for preparation of process water for presses, such as printing presses, or the like, including conditioning apparatus for conditioning the process water and cooling apparatus for cooling the process water, comprise a housing (1) which is spatially divided into upper and lower housing spaces (A, B), with the conditioning apparatus (2, 3, 4, 8, 13, 22-24) arranged in the lower housing space (B) and the cooling apparatus (9, 10) and a fan arrangement (11, 12) to produce a substantially upwardly directed exhaust stream of cooling air out of the housing arranged in the upper housing space (A). The cooling apparatus includes a refrigeration condenser arranged close to a cooling-air exhaust opening (12) at an upper side of the housing (1) so that the refrigeration condenser is subjected to cool air before it exits into a surrounding space.

11 Claims, 4 Drawing Sheets

APPARATUS FOR PREPARATION OF PROCESS WATER FOR PRESSES

BACKGROUND OF THE INVENTION

The invention concerns an apparatus for preparation of process water, or solution, (such as, damping solution, tempering water) for presses, such as printing presses, or the like, comprising apparatus for the conditioning of water and apparatus for the cooling of water.

The term "conditioning" should be understood to particularly, although not exclusively, include the preparation of a damping solution, for example, through admixture of a damping solution concentrate and, for example, isopropyl alcohol with flowing water in a particular mixture relationship, as well as the prewarming of water upon preparation of tempering water.

Appropriate dosing, mixing, and conveying devices as well as heating and regulating devices, for example a conveying pump with a constant, or supply, holder for the isopropyl alcohol, a manometer, a coupling for a mixing apparatus, a suction sleeve or discharge pipe, a circulating pump, a filter device, and the like, as well as a cooling unit for cooling a damping solution have been arranged in the prior art so that warmed exhaust air from a space of the cooling unit has exited to a surrounding work area in an inconvenient manner from a work-physiological point-of-view. In particular, cooling units have often been arranged below preparation, or conditioning devices. A further associated disadvantage, in addition to this work-physiological stress factor, is that a cooling air stream can come into contact with parts of the preparation, or conditioning, apparatus which can lead to contamination of this apparatus as a result of carried dust particles. Similar relationships have been connected with preparation of tempering (temperature controlling) water for inking, or color, friction rollers of presses in which necessary heating apparatus, such as an expansion container, shut off valves, safety valves, pressure and temperature regulators, pumps, a heating device, etc., are arranged in such a relationship to a cooling unit serving to cool water that a cooling air stream can come into contact with both tempering, that is temperature controlling, areas.

In contrast thereto, the invention has the purpose of providing an apparatus of the above described type which improves operational dependability while simultaneously significantly decreasing physiological work stress in a surrounding work area.

SUMMARY OF THE INVENTION

According to principles of this invention, the object of this invention is accomplished by providing a housing which is spatially divided into an upper space and a lower space with conditioning apparatus being arranged in the lower housing space and cooling apparatus being arranged in the upper housing space and a device to produce a substantially upwardly directed exhaust stream of cooling air out of the housing. An air-cooled cooling unit is in this manner arranged above the rest of the apparatus parts, which provides the possibility of installing a heat removing refrigeration condenser with an air-stream-producing fan arrangement so that an exiting stream of warmed exhaust air exiting the housing can be arranged and directed in such a manner that it causes substantially no work-place physiological stress for persons working in an area of a press. The apparatus makes possible further the directing of a cooling air stream exclusively through the upper space of the housing which is provided with the cooling unit so that the sensitive units, or set of machines, of the preparation (conditioning) or water prewarming devices are effectively protected from contamination due to dust particles contained in the cooling air. The construction of the apparatus with the over-and-under arranged functional spaces translates further to a substantial space savings, the possibility of more favorable working location of operating elements, and an easier complete enclosing for protection of components of the apparatus against damage.

BRIEF DESCRIPTION OF THE DRAWINGS

The foregoing and other objects, features and advantages of the invention will be apparent from the following more particular description of a preferred embodiment of the invention, as illustrated in the accompanying drawings in which reference characters refer to the same parts throughout the different views. The drawings are not necessarily to scale, emphasis instead being placed upon illustrating principles of the invention in a clear manner.

DESCRIPTION OF A PREFERRED EMBODIMENT

Figure 2:
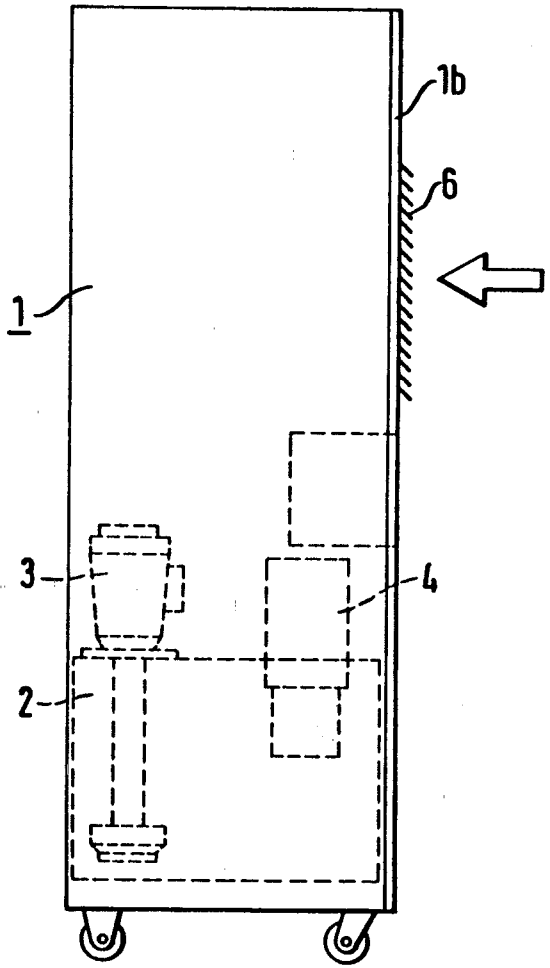
FIG. 2 is a side view of the apparatus of FIG. 1.
Figure 1:
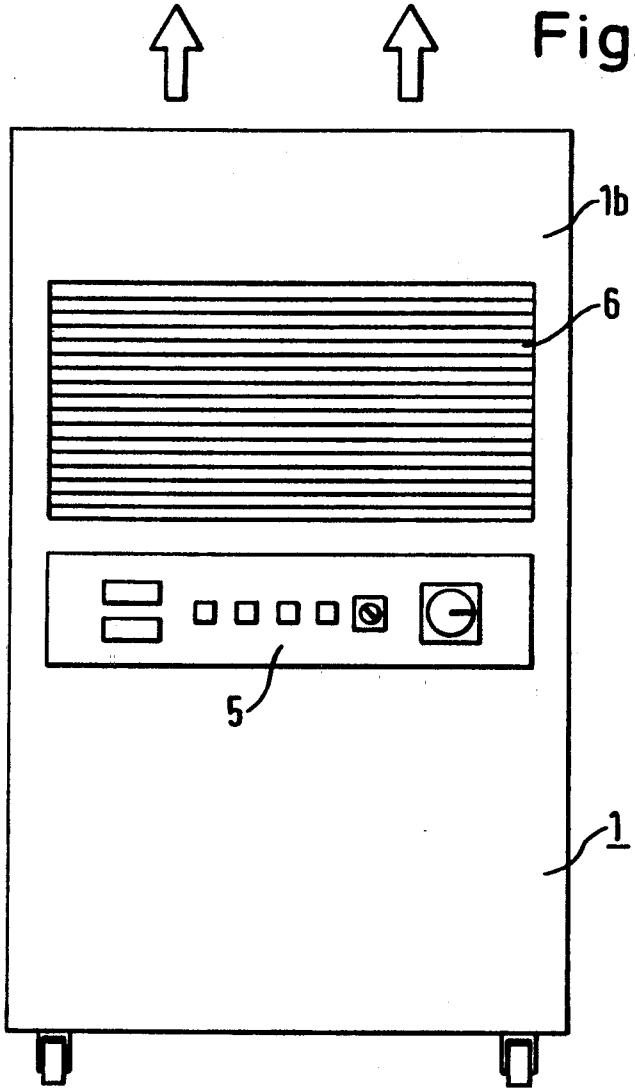
FIG. 1 is a front view of an apparatus for preparation of damping solution, or water, according to a first embodiment of the invention.
Figure 3:
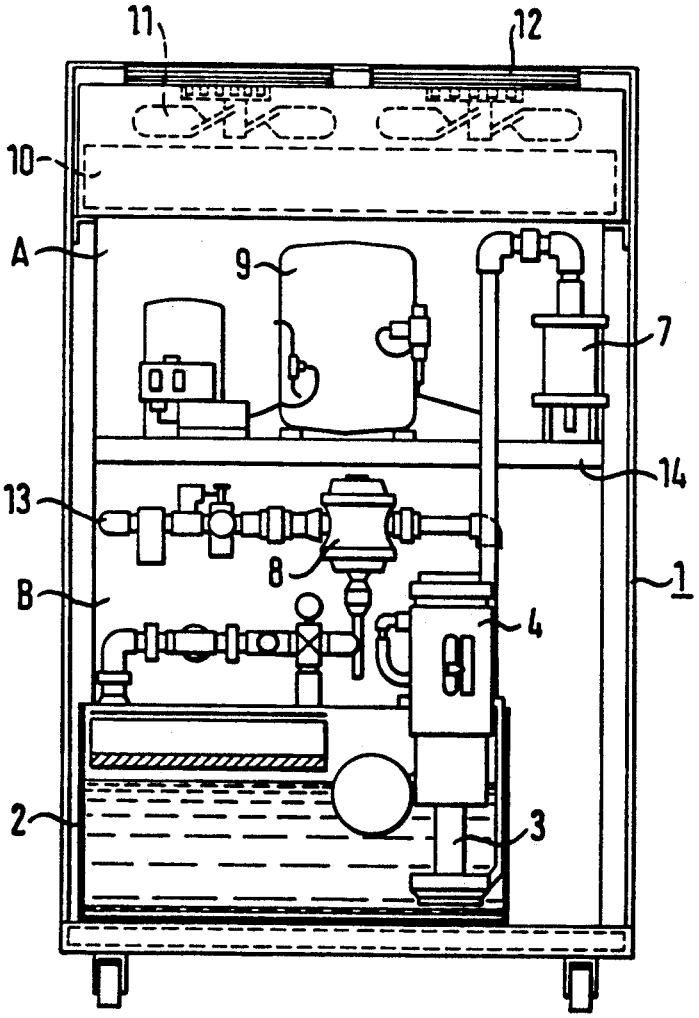
FIG. 3 is a front view similar to FIG. 1 but with a front enclosing wall being removed.

As is represented in FIGS. 1 through 3 an apparatus according to the first embodiment is enclosed in a substantially closed-on-all-sides housing 1 of which a front enclosing wall 1*b* is particularly arranged to be removable for providing possible access into the interior of the housing 1. The housing 1 is divided, or separated, into substantially two functional spaces, namely, a lower space B and an upper space A which are separated from one another by an appropriate device, for example in the form of an intermediate, separating, or floor, wall 14.

According to the invention, a device for preparation of a damping solution, or a damping water, is mounted in the lower housing space B which, in a known manner, can include a damping solution, or damping water, holder 2 with an emersed pump 3, a dosing automat, or dispenser, 8, an alcohol constant holder 4, a damping water holder 2 as well as a connecting fitting 13 for supplying fresh water. The dosing automat 8 serves to allot, or introduce, a damping solution concentrate into fresh water passing through the connecting fitting 13. The constant holder 4 can dose, or inject, alcohol into damping solution, or water, in the holder 2 in dependence upon consumption. The construction and function of the remaining components of the preparation apparatus mounted in the lower housing space B are well known so that further description thereof is not necessary.

According to this invention, a device for cooling the prepared damping solution, or water, is mounted in the upper housing space A. The cooling device includes an air cooled, preferably hermetically-sealed, cooling unit 9, a refrigeration condenser 10, and a fan arrangement 11 for producing a cooling air stream lengthwise of the cooling unit 9 and serving the refrigeration condenser 10.

The cooling air enters the upper housing space A through an entrance opening 6 provided with a grill, or screen, on the front side of the housing 1 and exits the housing via one or more exhaust openings 12 on a housing top side after it has streamed along the cooling unit 9 and the coolant condenser 10; compare also the arrows in FIGS. 1 and 2. Because the exhaust openings 12 for cooling air are provided on the top side of the housing, an exhaust stream is produced which is substantially vertically, upwardly, directed.

The coolant, or refrigeration, condenser 10 is arranged above the cooling unit 9 in a horizontal attitude. In this manner, the fan arrangement 11 is between the exhaust openings 12 and the coolant condenser 10, in which manner a desired substantially vertical alignment of the exhaust air stream is allowed.

The cool air flows substantially only through the upper housing space A so that the lower housing space B is not subjected to an air stream and in this manner a resulting contamination of parts of the preparation, or conditioning, devices will be avoided.

A heat exchanger provided in the upper housing space A is identified by a reference character 7 through which the prepared damping solution flows and is thereby cooled.

As is shown in FIG. 1, an electrical supply apparatus, including control and regulating elements, can be arranged in a circuit box 5 on the front side of the housing 1.

Figure 4:
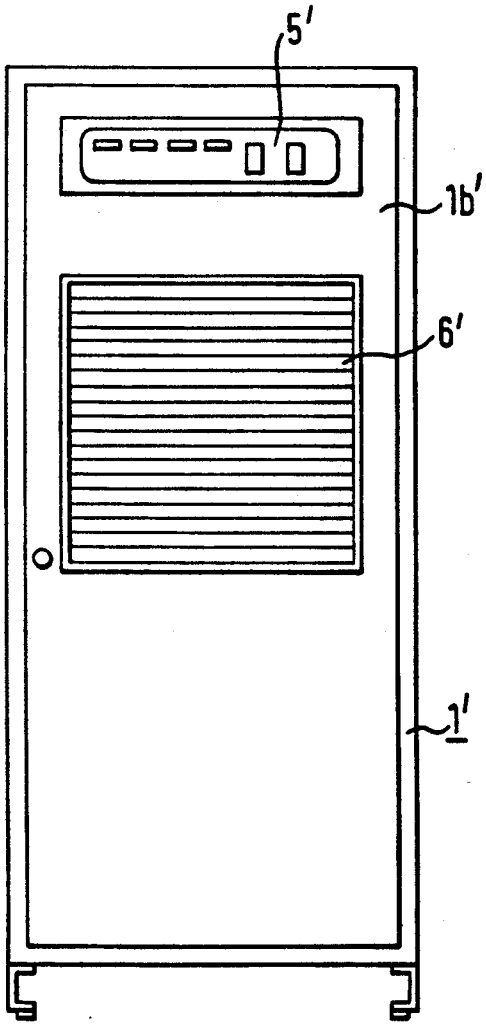
FIG. 4 is a front view of an apparatus for preparation of tempering water according to a second embodiment of the invention.
Figure 5:
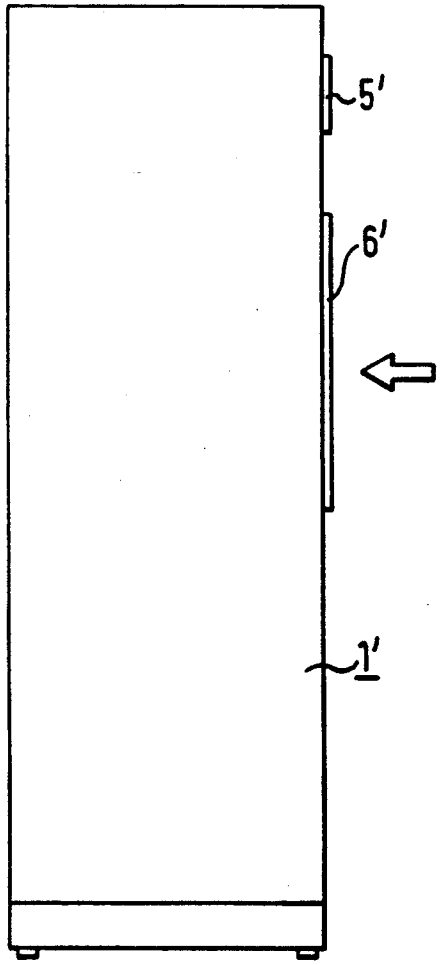
FIG. 5 is a side view similar to FIG. 2 of the apparatus of FIG. 4.
Figure 6:
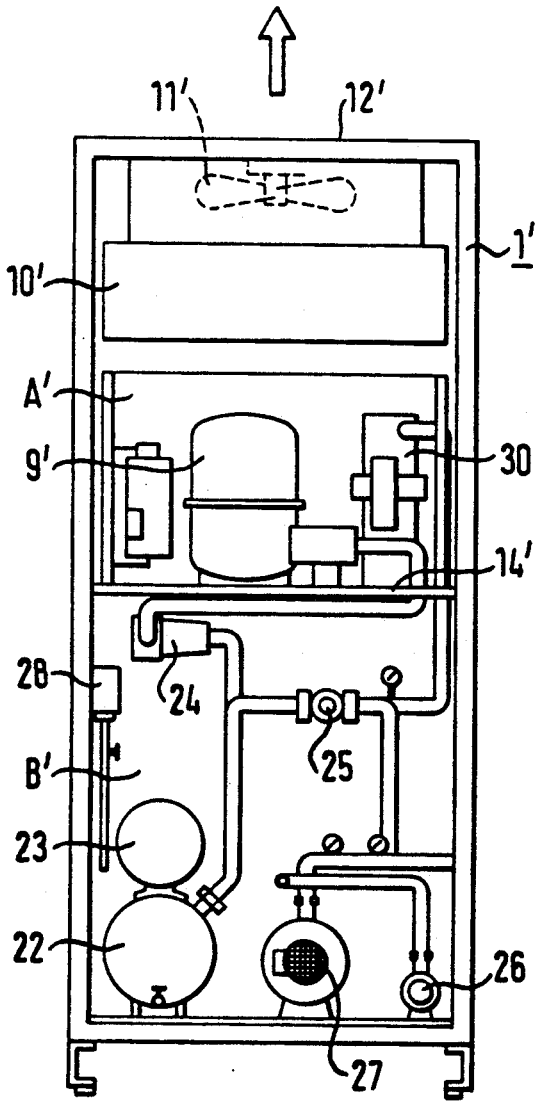
FIG. 6 is a front view similar to FIG. 4 but with a front enclosing wall being removed.

A second embodiment of the invention shown in FIGS. 4 through 6 differs from that which is described above mainly in functioning parts which are mounted in the lower housing space. Identical or similar parts as those of the above described embodiment are provided in FIGS. 4 through 6 with the same reference numerals being used, but having "′" indicia thereon and they require no new description.

According to this invention, heating, regulating, measuring, and pumping devices are stored in the lower housing space B′ which include a well known water supply holder 22, a pressure balancing, or surge, tank 23, a water pump 24, a 3-way mixing valve 25, a flow-through heater 26, a tempering-water pump 27, and a safety pressure switch 28. Otherwise, the construction and function of these components for the tempering water preparation are well known so that a more detailed description is not necessary.

Cool air flows through substantially only the upper housing space A′ so that the lower housing space B′ is subjected to no air stream and thereby contamination of parts of the tempering water preparation device can be avoided. The cool air exits the upper housing space A′ at an upper side exit opening 12′ in which manner workplace physiological stress for those persons working in an area of the apparatus can be effectively avoided.

A plate heat exchanger 30 is arranged in the upper housing space A′ to which is applied the tempering water for its cooling.

While the invention has been particularly shown and described with reference to preferred embodiments, it will be understood by those skilled in the art that various changes in form and detail may be made therein without departing from the spirit and scope of the invention.

The embodiments of the invention in which an exclusive property or privilege are claimed or defined as follows:

I claim:

1. Apparatus for preparation of process water passing through said apparatus for consumption by presses including means for circulating process water through said apparatus, a conditioning means for cooling the process water wherein the improvement comprises a housing which is spatially divided by walls into upper and lower housing spaces , with the conditioning means for conditioning said process water arranged in the lower housing space and the cooling means for cooling said process water and an air-stream means for producing a substantially upwardly directed exhaust stream of cooling air out of the housing arranged in the upper housing space.

2. Apparatus as in claim 1 wherein the air-stream means is a fan arrangement and the cooling means includes a refrigeration condenser arranged close to a cooling-air exhaust opening provided at an upper side of the housing so that the refrigeration condenser is flowed through by cooling air before it exits into a surrounding space.

3. Apparatus as in claim 1 wherein a front side of the upper housing space is provided with air entrance openings for producing a cooling air stream substantially only through the upper housing space.

4. Apparatus as in claim 1 as used for the preparation of damping solution wherein the conditioning means includes a damp-water-preparation device.

5. Apparatus as in claim 1 as used for preparation of tempering water wherein the conditioning means substantially includes heating, regulating, and pumping devices for the prewarming of water.

6. Apparatus as in claim 2 wherein a front side of the upper housing space is provided with air entrance openings for producing a cool air stream substantially only through the upper housing space.

7. Apparatus as in claim 2 as used for the preparation of damping solution wherein the conditioning means includes a damp-water-preparation device.

8. Apparatus as in claim 3 as used for the preparation of damping solution wherein the conditioning means includes a damp-water-preparation device.

9. Apparatus as in claim 2 as used for preparation of tempering water wherein the conditioning means substantially includes heating, regulating, and pumping devices for the prewarming of water.

10. Apparatus as in claim 3 as used for preparation of tempering water wherein the conditioning means substantially includes heating, regulating, and pumping devices for the prewarming of water.

11. Apparatus as in claim 1 wherein said cooling means includes a heat exchanger in said upper housing space through which said process water flows for cooling.

* * * * *